US010606198B2

(12) United States Patent
Nishikawa et al.

(10) Patent No.: US 10,606,198 B2
(45) Date of Patent: Mar. 31, 2020

(54) FIXING APPARATUS FOR FIXING A TONER IMAGE ON A RECORDING MEDIUM

(71) Applicant: CANON KABUSHIKI KAISHA, Tokyo (JP)

(72) Inventors: Taku Nishikawa, Yokohama (JP); Motoyasu Muramatsu, Susono (JP); Satoshi Murasaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/054,374

(22) Filed: Aug. 3, 2018

(65) Prior Publication Data

US 2019/0041782 A1 Feb. 7, 2019

(30) Foreign Application Priority Data

Aug. 7, 2017 (JP) ..... 2017-152379

(51) Int. Cl.

*G03G 21/16* (2006.01)
*G03G 15/20* (2006.01)
*G03G 15/00* (2006.01)

(52) U.S. Cl.

CPC ..... *G03G 15/2064* (2013.01); *G03G 15/2028* (2013.01); *G03G 15/2053* (2013.01); *G03G 15/80* (2013.01); *G03G 21/1647* (2013.01); *G03G 21/1652* (2013.01); *G03G 21/1685* (2013.01); *G03G 2215/2016* (2013.01); *G03G 2215/2035* (2013.01); *G03G 2221/166* (2013.01); *G03G 2221/1639* (2013.01)

(58) Field of Classification Search

CPC ..... G03G 15/2064; G03G 21/1647; G03G 21/1652; G03G 21/1685; G03G 15/80; G03G 15/2028; G03G 2221/166; G03G 2221/1639; G03G 15/2017; G03G 15/2053; G03G 2215/2003; G03G 2215/2016

See application file for complete search history.

(56) References Cited

U.S. PATENT DOCUMENTS

| | | | | |
|---|---|---|---|---|
| 9,069,305 | B2 * | 6/2015 | Suzuki | G03G 15/2053 |
| 2014/0105634 | A1 * | 4/2014 | Tanaka | G03G 15/2042 399/90 |
| 2015/0277309 | A1 * | 10/2015 | Kuroda | G03G 15/2053 219/541 |
| 2017/0060029 | A1 * | 3/2017 | Yomoda | G03G 15/0886 |
| 2018/0253054 | A1 * | 9/2018 | Tanto | G03G 21/1685 |

FOREIGN PATENT DOCUMENTS

JP 2015-191734 A 11/2015

* cited by examiner

*Primary Examiner* — David M. Gray
*Assistant Examiner* — Laura Roth
(74) *Attorney, Agent, or Firm* — Canon U.S.A., Inc. I.P. Division

(57) ABSTRACT

A fixing apparatus will be described for fixing a toner image on a recording medium. The apparatus includes a heater that is in contact with an inner surface of a film, a restricting member that restricts movement of the film in a longitudinal direction of the film, a connector that is connected electrically to the heater for supplying electric power to the heater, and a lock member that maintains a position of the restricting member and a position of the connector relative to each other.

14 Claims, 8 Drawing Sheets

FIXING APPARATUS FOR FIXING A TONER IMAGE ON A RECORDING MEDIUM

BACKGROUND OF THE INVENTION

Field of the Invention

The present invention relates to a fixing apparatus that fixes a toner image formed on a recording medium to the recording medium.

Description of the Related Art

Image-forming apparatuses that use a fixing apparatus that employs a film heating process to fix a toner image transferred onto a surface of a print medium are known. The fixing apparatus that uses the film heating process includes a film having a cylindrical shape, a heater in contact with the inner surface of the film, and a pressing roller that forms a nip region in collaboration with the heater with the film being interposed between the pressing roller and the heater.

The heater has a substrate that is shaped like a flat plate and on which a heat generating resistor pattern is formed. Electrodes that establishes an electric connection are formed at an end of the heat generating resistor pattern. The electrodes disposed on the heater substrate are brought into contact with a connection terminal that has a spring capability and is disposed on a connector. The connector is inserted into the heater such that the electrodes are in contact with the connection terminal. The connection terminal is electrically connected via an electric cable to a power supply of the image-forming apparatus.

In this configuration, it is necessary to maintain the state of contact between the electrodes of the heater and the connection terminal of the connector. In order to prevent the connector from being displaced with respect to the heater, a configuration of preventing such displacement has been proposed. In Japanese Patent Laid-Open. No. 2015-191734, a heater-side locking portion is provided in the heater and a connector-side locking portion is provided in the connector, and the engagement of the heater-side locking portion and the connector-side locking portion restricts displacement of the connector.

In this configuration, the displacement is restricted directly by the connector and the heater. Accordingly, if an external force is applied to the connector, for example, during assembling work, the heater receives the external force because the heater restricts displacement of the connector, which results in the heater sustaining damage.

The present invention provides a fixing apparatus in which the state of contact between a heater and a connector is reliably maintained and the heater is prevented from sustaining damage.

SUMMARY OF THE INVENTION

The present invention provides a fixing apparatus that includes a film that is cylindrically shaped and rotates with the film in contact with the recording medium, a heater that is in contact with an inner surface of the film, a restricting member that restricts movement of the film in a longitudinal direction of the film, a connector that is connected electrically to the heater for supplying electric power to the heater, and a lock member that maintains a position of the restricting member and a position of the connector relative to each other.

Further features of the present invention will become apparent from the following description of exemplary embodiments with reference to the attached drawings.

DESCRIPTION OF THE EMBODIMENTS

Exemplary embodiments will be described in detail with reference to the drawings. Note that dimensions, materials, shapes, relative positions, or the like of elements described in the embodiments below ay be changed appropriately in accordance with a configuration and various conditions of an apparatus to which the invention is applied. Accordingly, the embodiments described below should not be construed as limiting the scope of the invention unless specifically described otherwise.

First Embodiment

Figure 8:
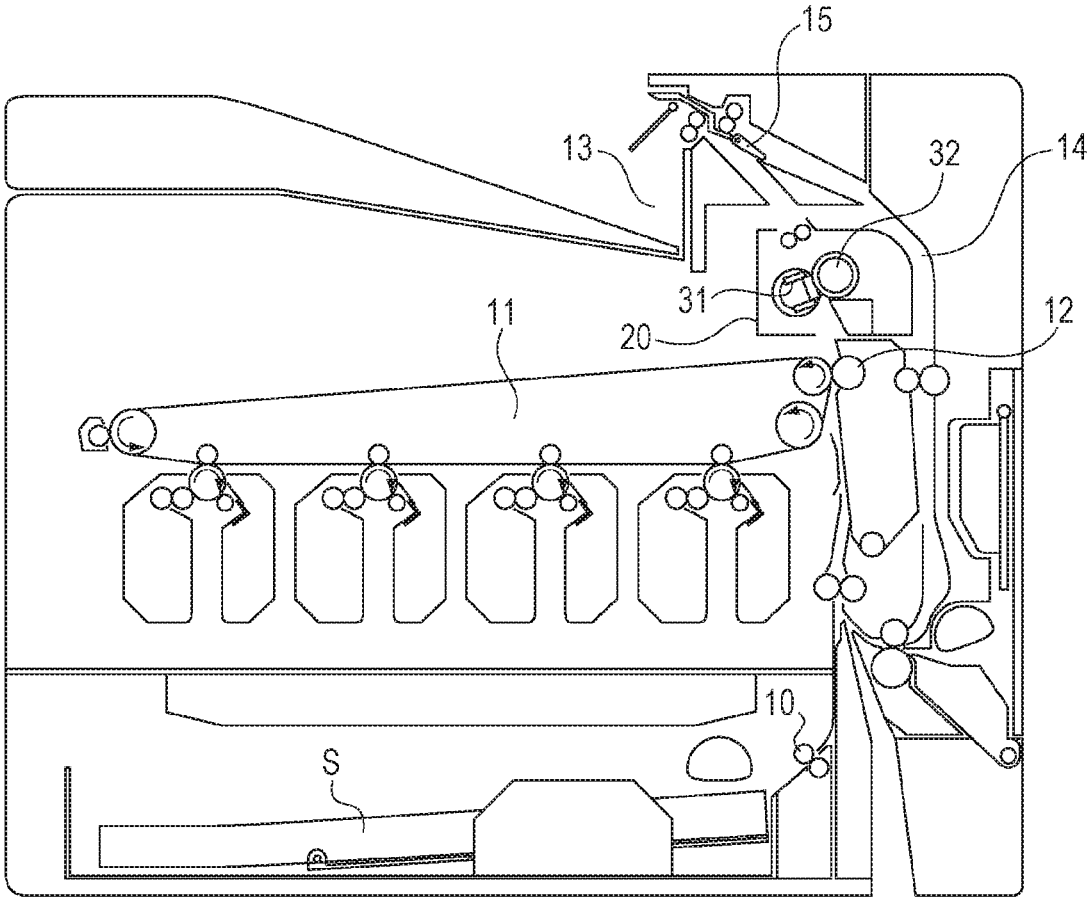
FIG. 8 is a cross-sectional view illustrating an image-forming apparatus equipped with the fixing apparatus.

First, an image-forming apparatus equipped with a fixing unit (fixing apparatus) 20 will be outlined with reference to FIG. 8. An exemplary image-forming apparatus described herein is a laser printer that forms toner images on recording media S by using electrophotographic technology. FIG. 8 is a cross-sectional view illustrating an image-forming apparatus equipped with the fixing unit 20. A toner image formed at an image-forming section 11 is transferred, at a transfer section 12, onto a recording medium S that is fed from a sheet feed section 10. The recording medium S subsequently passes through the fixing unit 20. The fixing unit 20 fixes the toner image onto the recording medium S, and the recording medium S is discharged from a sheet discharge section 13. In the case of double-sided printing, a recording medium S on one side of which an image has been formed is switched back (conveyed inversely) before the trailing edge of the recording medium S passes a flapper 15 for discharge from the sheet discharge section 13. The recording medium S subsequently passes through a double-sided recording path 14, passes again through the transfer section 12 and the fixing unit 20, and is discharged.

Figure 1:
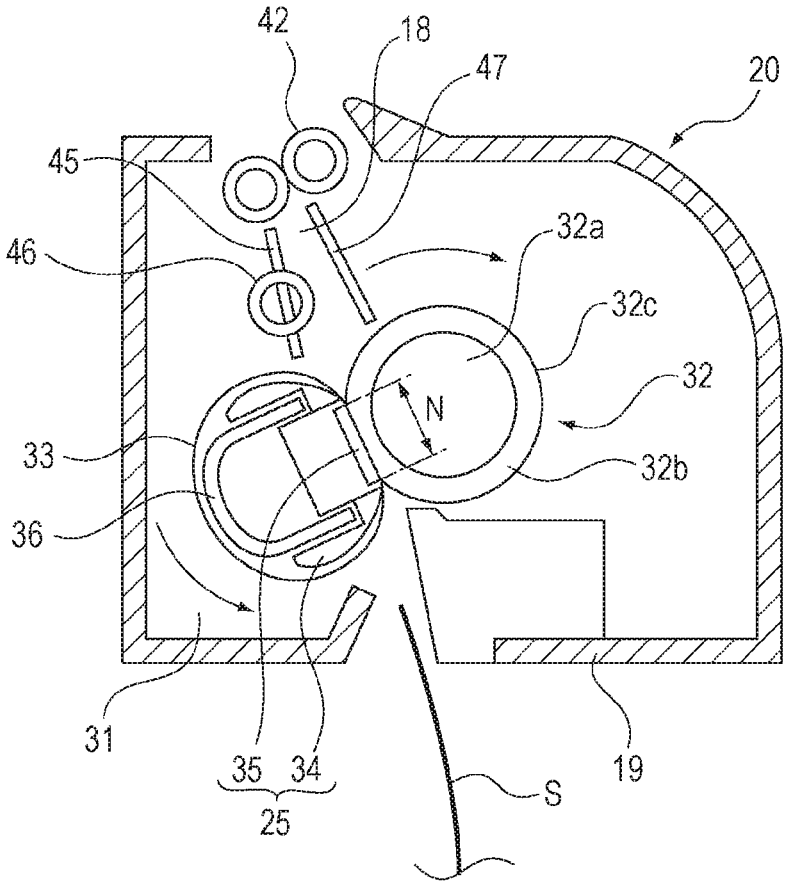
FIG. 1 is a principal section of a fixing apparatus according to a first embodiment.

Next, the fixing unit 20 will be described with reference to FIG. 1. FIG. 1 is a principal section of the fixing unit 20 according to a first embodiment. As illustrated in FIG. 1, the fixing unit 20 includes a film assembly 31, a pressing roller 32, a conveyance roller 42, a sheet conveyance guide 18, and a casing 19. The film assembly 31 is a first fixing member (heating member), and the pressing roller 32 is a second fixing member (pressing member). A fixing nip region N is formed by pressing the film assembly 31 and the pressing roller 32 against each other.

The film assembly 31 has a fixing film 33, a heater 35, a heater holder 34 that holds the heater 35, and a pressing stay 36. The heater holder 34 also serves to guide rotation of the fixing film 33. The fixing film 33 (hereinafter simply referred to as "film") has a cylindrical shape and is flexible. The heater 35 has an elongated plate-like substrate made of a ceramic material, such as aluminum nitride or alumina. The heater 35 also has a heat generating resistor and electrodes. The heat generating resistor is made of a palladium-silver alloy or the like and printed on the substrate. The electrodes are made of silver or the like and connected electrically to the heat generating resistor. The heater holder 34 is made of a heat-resistant resin for which polyphenylene sulfide (PPS) is used in the present embodiment. A heater 35 is inserted into and fixed to (or held by) a groove provided in the outer surface of the heater holder 34 in the longitudinal direction thereof. The film 33 is fitted loosely around the heater holder 34. The pressing stay 36 is made of iron and has a U-shaped cross section. The pressing stay 36 is rigid and is installed inside the heater holder 34. The pressing stay 36 serves to reinforce the heater holder 34. The heater 35 and the heater holder 34 are combined to form a heater assembly 25, and a connector 38 that supplies electricity to the heater 35 engages the heater assembly 25.

Figure 2:
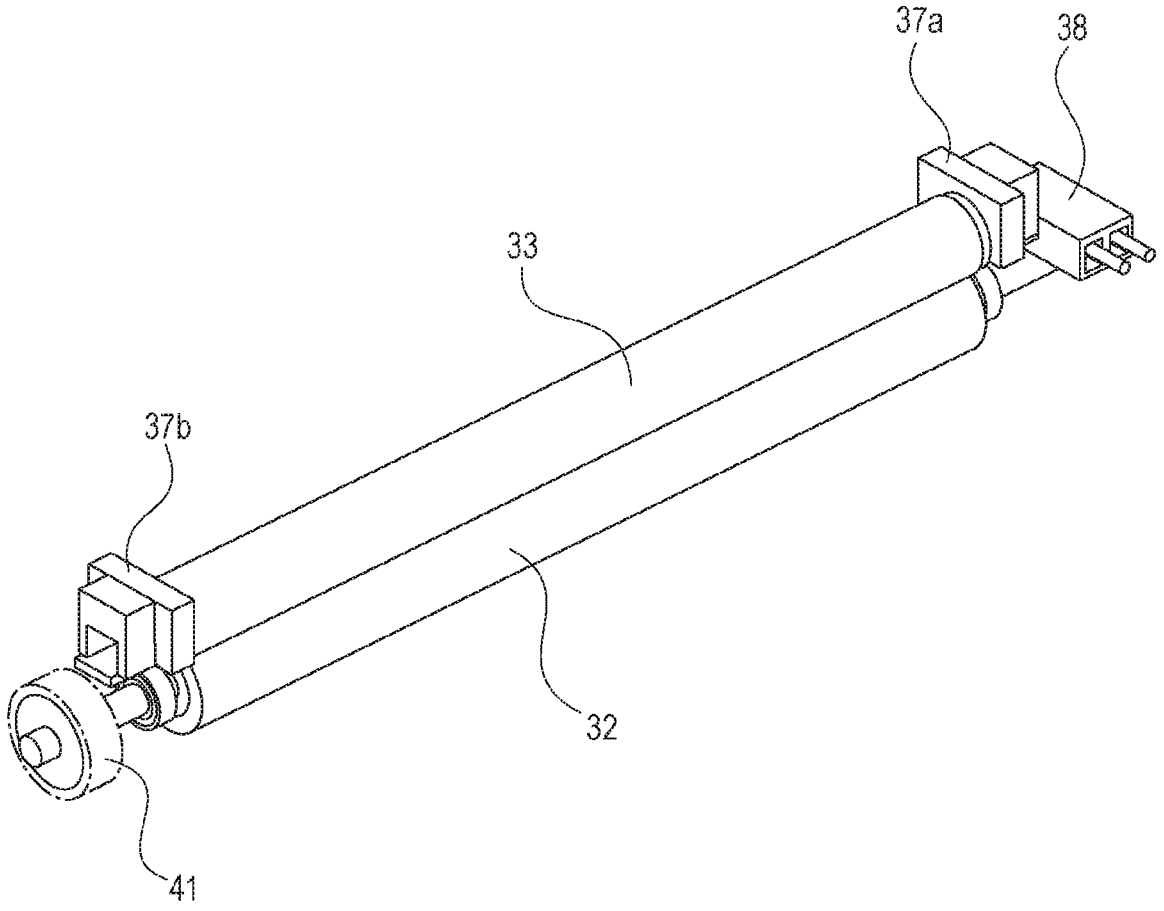
FIG. 2 is a perspective view illustrating the vicinity of a heating member and a pressing roller according to the first embodiment.

As illustrated in FIG. 2, a holder 37*a* and a holder 37*b*, which are made of a heat-resistant resin (such as PPS as in the present embodiment), are disposed so as to oppose each other at respective longitudinal ends of the film 33. The holders 37*a* and 37*b* restrict movement of the film 33 in the longitudinal direction thereof. The holders 37*a* and 37*b* are in contact with the inner peripheral surface of the film 33 and thereby regulates the rotation path of the film 33. The holders 37*a* and 37*b* serve as restricting members that restrict movement of the film 33 in the longitudinal direction. The holders 37*a* and 37*b* also serve as guiding members that guide rotation of the film 33.

The film 33 has a structure in which an elastic layer made of silicone rubber or the like and a releasing layer made of fluororesin or the like are added onto the outer peripheral surface of a base layer made of a heat-resistant resin (e.g., polyimide) or a metal (e.g., stainless steel).

The pressing roller 32 is constituted by a metal core 32*a* and an elastic layer 32*b* provided around the metal core 32*a*. The elastic layer 32*b* is made of silicone rubber or the like and exhibits a predetermined hardness. In order to decrease adhesiveness, the pressing roller 32 may have a fluororesin layer 32*c* on the outermost surface thereof. The fluororesin layer 32*c* is made of, for example, polytetrafluoroethylene (PTFE), a tetrafluoroethylene-perfluoroalkyl vinyl ether copolymer (PFA), or a tetrafluoroethylene-hexafluoropropylene copolymer (FEP).

Figure 3:
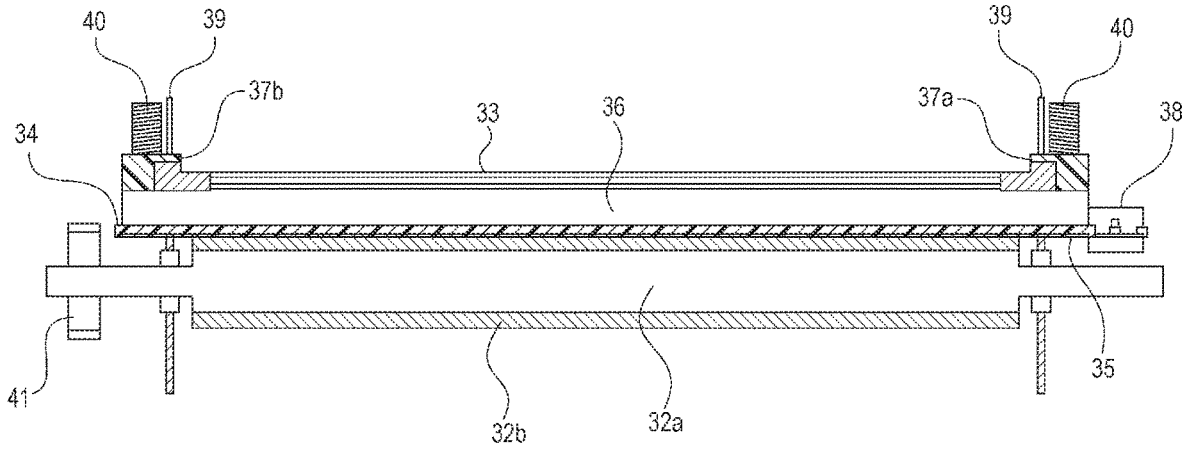
FIG. 3 is a cross-sectional view illustrating the vicinity of the heating member and the pressing roller according to the first embodiment when viewed perpendicularly to a sheet conveyance direction.

As illustrated in FIG. 2, a drive gear 41 is disposed at an end of the pressing roller 32, and the drive gear 41 is rotated by a gear (not illustrated) disposed in the apparatus (printer) body. The film 33 passively rotates in accordance with the rotation of the pressing roller 32. The pressing roller 32 is rotatably held by a frame 39 of the fixing unit 20. The film assembly 31 is also attached to the frame 39. As illustrated in FIG. 3, the film assembly 31 and the pressing roller 32 are urged by coil springs 40 via respective holders 37*a* and 37*b* in a direction in which the film assembly 31 and the pressing roller 32 are pressed against each other. Urging forces of the coil springs 40 are transmitted to the pressing roller 32 via the respective holders 37*a* and 37*h*, the pressing stay 36, the heater holder 34, the heater 35, and the film 33. The fixing nip region N is formed by pressing the film 33 and the pressing roller 32 against each other. The connector 38 is connected electrically to the electrodes of the heater 35.

Next, movement of a recording medium S within the fixing unit 20 will be described. The recording medium S and the film 33 are brought into close contact with each other in the fixing nip region N. In this state, a recording medium S passes through the fixing nip region N. In this process, thermal energy is transferred by the heater 35 via the film 33 to an unfixed toner image that is born on the recording medium S. The unfixed toner image is thereby heated, fused, and fixed on the recording medium S. The recording medium S that has passed through the fixing nip region N is subsequently separated from the outer peripheral surface of the film 33 due to the stiffness of the recording medium S and the action of a separation member 45. The recording medium S is conveyed to the conveyance roller 42 while guided by the separation member 45, a conveyance guide 47, and a conveyance idler roller 46. The conveyance guide 47 is disposed in an upper region in the conveyance path of the recording medium S in which the separation member 45 is provided. The conveyance idler roller 46 is disposed in the separation member 45. The recording medium S is subsequently conveyed to the sheet discharge section 13 and discharged therefrom.

Next, with reference to FIG. 4 and FIG. 5, the vicinity of the holder 37*a* at an end of the film assembly 31 according to the first embodiment will be described.

Figure 4:
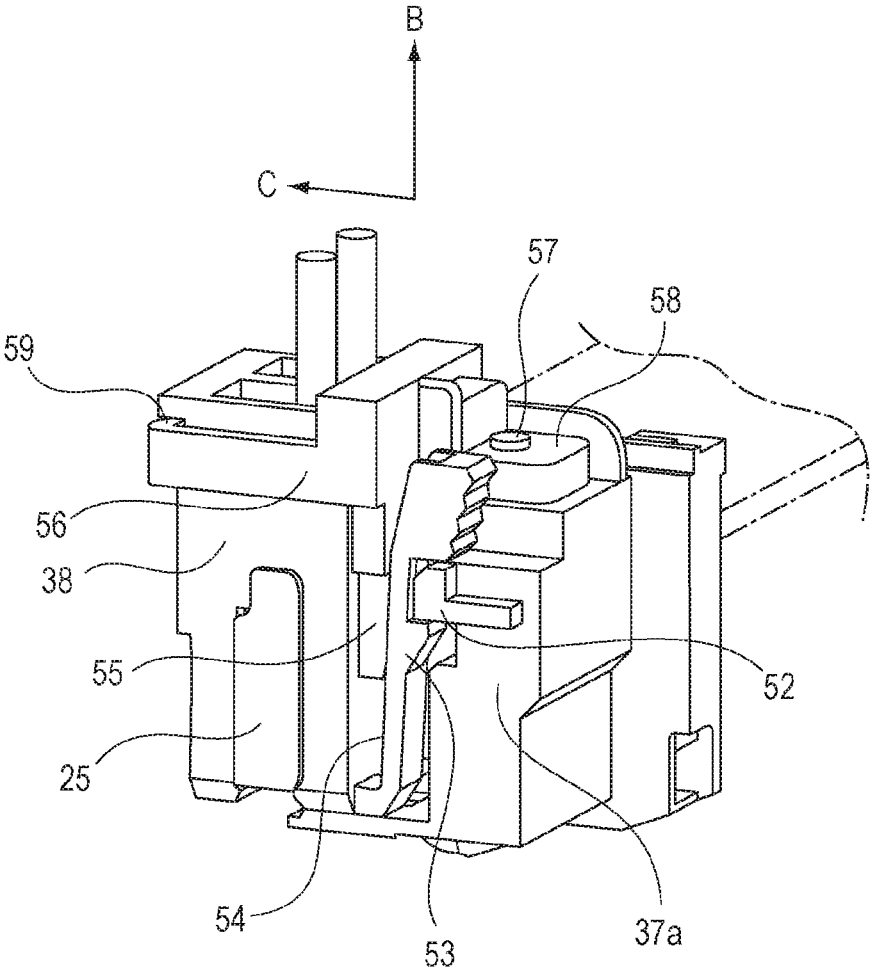
FIG. 4 is a perspective view illustrating the vicinity of a holder at an end of a film assembly according to the first embodiment.

FIG. 4 is a perspective view illustrating the vicinity of the holder 37*a* at an end of the film assembly 31. The respective ends of the heater assembly 25 are held by the holder 37*a* and the holder 37*b* (see FIG. 3), which serve as holder members. The connector 38 is attached to the heater assembly 25. The connector 38 has a connection terminal (not illustrated), and the connector 38 is in contact with the electrodes (not illustrated) of the heater 35. The connector 38 and the heater 35 are thereby connected electrically to each other. The holder 37*a* has a first locking portion 52 and a boss 57. The connector 38 has a second locking portion 53 that engages the first locking portion 52. The second locking portion 53 is disposed, so as to enable engagement with the first locking portion 52, at the end of an elastic portion 54 that is disposed in the connector 38.

Figure 5:
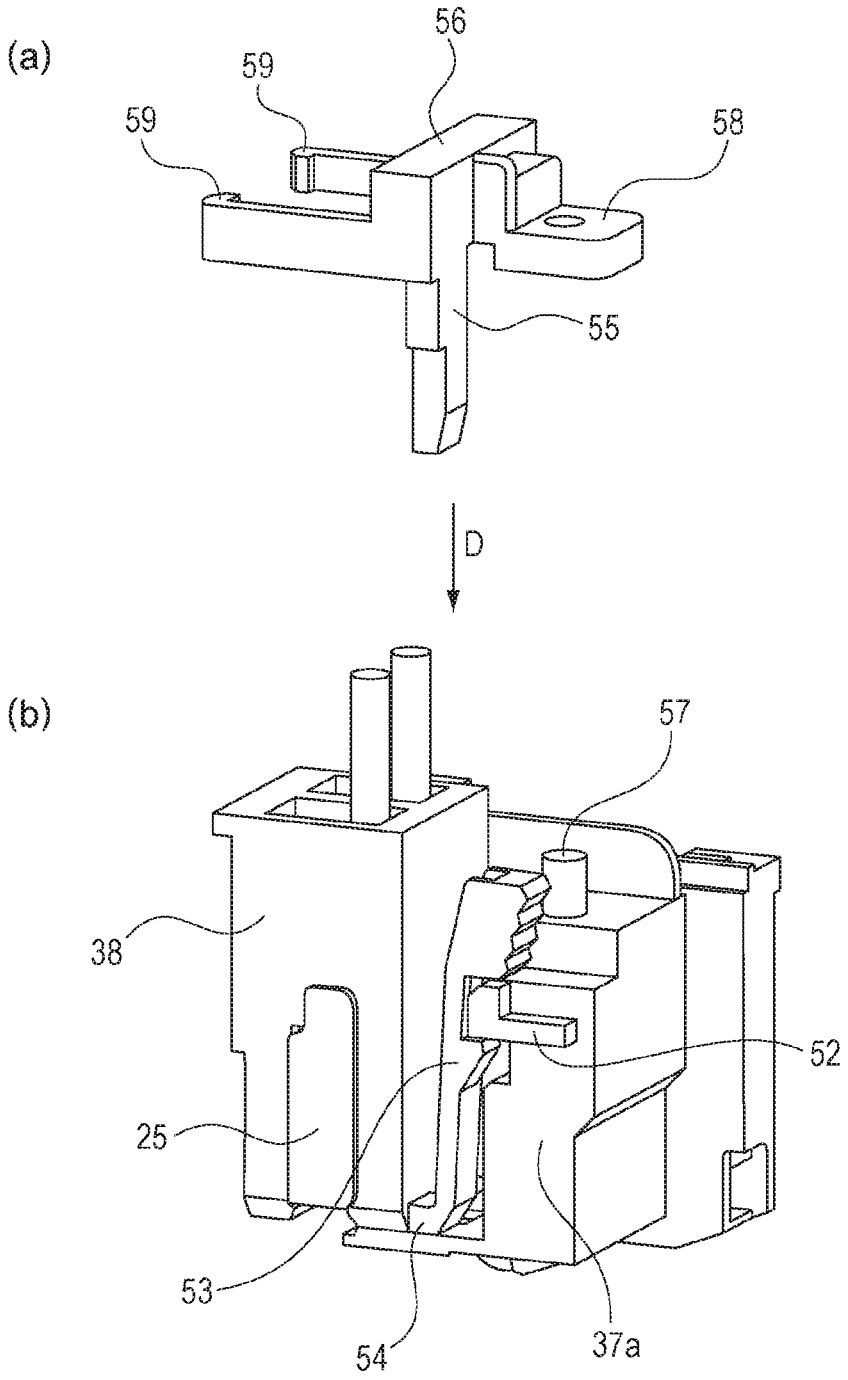
FIG. 5 is a perspective view illustrating a lock member according to the first embodiment and the vicinity of the holder before the lock member is mounted.

FIG. 5(*a*) is a perspective view illustrating a lock member 56 according to the present embodiment. The lock member 56 has a circular hole 58 that serves as a holder restriction portion, a tab portion 55, and connector holders 59 that serve as connector restriction portions that are capable of elastic deformation. The circular hole 58 and the tab portion 55, which serve as the holder restriction portions, fix the position of the holder 37*a*. The connector holders 59, which serve as the connector restriction portions, fix the position of the connector 38. With this configuration, the lock member 56 maintains the position of the holder 37*a* and the position of the connector 38 relative to each other. A detailed description will be given below.

FIG. 5(*b*) is a perspective view illustrating the vicinity of the holder 37*a* before the lock member 56 is mounted. The lock member 56 is inserted in the direction of arrow D and mounted on the holder 37*a*, and, as illustrated in FIG. 4, the lock member 56 maintains the position of the holder 37*a* and the position of the connector 38 relative to each other.

With reference to FIG. 4, a configuration of the lock member 56 will be described below. The circular hole 58 of the lock member 56 engages the boss 57 that is disposed on the holder 37*a*. The tab portion (deformation restriction portion) 55 of the lock member 56 is inserted into the gap between the body of the connector 38 and the elastic portion 54 of the connector 38. The tab portion 55 restricts deformation of the elastic portion 54 and thereby prevents the second locking portion 53 from being disengaging from the first locking portion 52. The connector holders 59 of the lock member 56 hold the connector 38 so as to embrace the connector 38 from both sides.

Next, advantageous effects of the lock member 56 will be described. The tab portion 55 of the lock member 56 restricts deformation of the elastic portion 54 of the connector 38 and thereby prevents the second locking portion 53 from detaching from the first locking portion 52. The engagement between the first locking portion 52 of the holder 37*a* and the second locking portion 53 of the connector 38 restricts movement of the connector 38 in the direction of arrow B. The engagement between the boss 57 of the holder 37*a* and the circular hole 58 of the lock member 56 prevents the lock member 56 from moving in the direction of arrow C. In addition, the connector holders 59 of the lock member 56 embrace the connector 38 from both sides and thereby prevent the connector 38 from moving in the direction of arrow C.

When an external force is applied to the connector 38 in the direction of arrow B, the external force in the direction of arrow B is eventually received by the frame 39 that holds the holder 37*a* that restricts movement of the connector 38 in the direction of arrow B. As a result, the external force does not apply to the heater assembly 25.

When an external force is applied to the connector 38 in the direction of arrow C, the external force in the direction of arrow C is transmitted to the lock member 56 via the connector holders 59 that restrict movement of the connector 38 in the direction of arrow C. The external force is eventually received by the frame 39 that holds the holder 37*a* that restricts movement of the lock member 56 in the direction of arrow C. As a result, the external force does not apply to the heater assembly 25.

According to the present embodiment, as described above, when an external force is applied to the connector 38, the contact state of the heater assembly 25 and the connector 38 is reliably maintained, and the heater assembly 25 is prevented from receiving the external force and thereby from sustaining damage.

Second Embodiment

Next, a second embodiment will be described. In the present embodiment, elements similar to those described in the first embodiment are denoted by like reference symbols, and description on elements having similar configurations or similar functions will be omitted.

The general configuration of the image-forming apparatus and the general configuration of the fixing unit included in the image-forming apparatus are similar to those described in the first embodiment, and thus duplicated description will be omitted.

Figure 6:
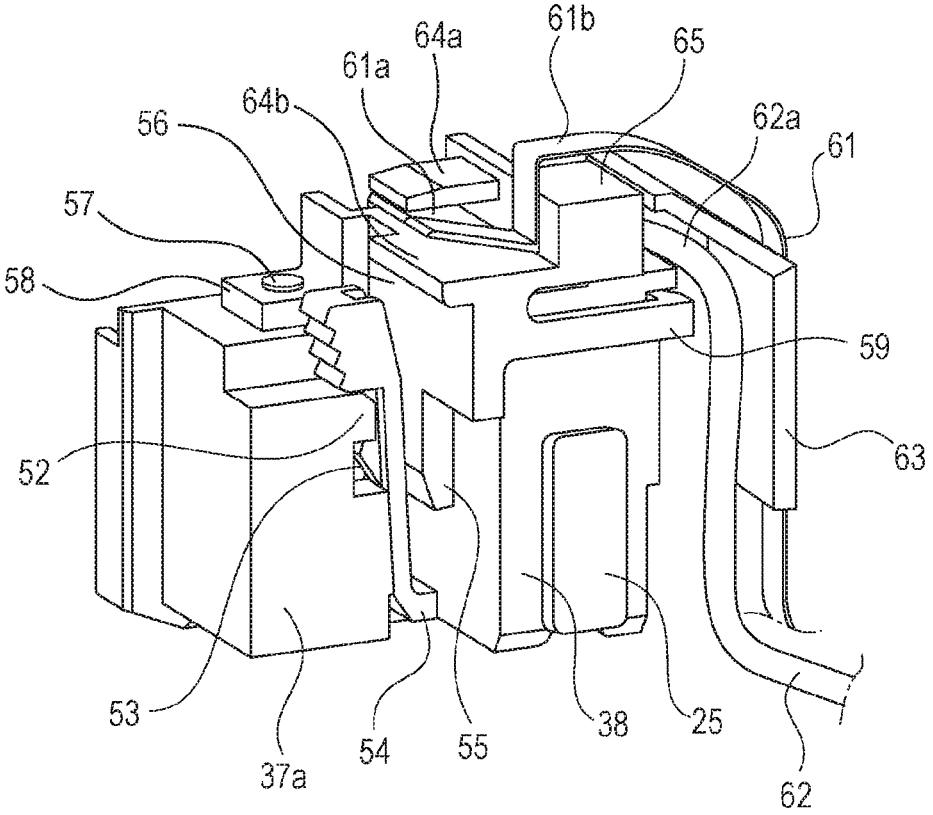
FIG. 6 is a perspective view illustrating the vicinity of a holder at an end of a film assembly according to a second embodiment.
Figure 7:
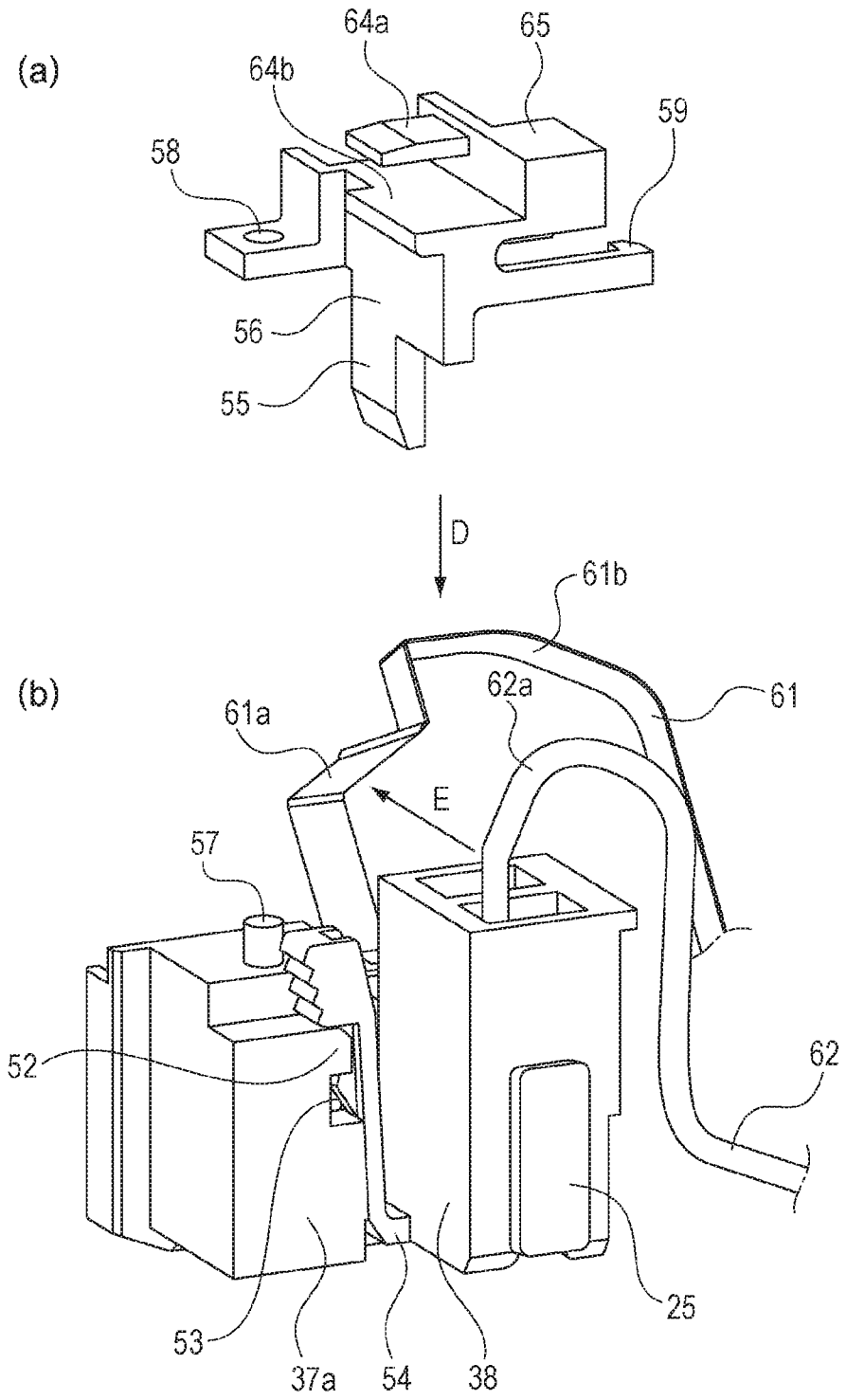
FIG. 7 is a perspective view illustrating the lock member according to the second embodiment and the vicinity of the holder before the lock member is mounted.

With reference to FIG. 6 and FIG. 7, the vicinity of the holder 37*a* at an end of the film assembly 31 according to the second embodiment will be described.

FIG. 6 is a perspective view illustrating the vicinity of the holder 37*a* at an end of the film assembly 31. One end of an electric cable 62 is connected to the connection terminal of the connector 38 and the other end is connected to a power supply of the image-forming apparatus. Electric power is supplied to the heater 35 via the electric cable 62 and the connector 38. One end of a flat cable 61 is connected to a thermistor (temperature sensor)(not illustrated), whereas the other end is connected to a control section (not illustrated). The thermistor is an element that detects the temperature of the heater 35. A guide 63 is attached to a member (not illustrated) located outside the film assembly 31. If the flat cable 61 and the electric cable 62 extend in parallel or intersect each other in close proximity, electrical signals may pick up noises. It is necessary to maintain a distance between the flat cable 61 and the electric cable 62 in order to prevent noises from entering the electrical signals. In the present embodiment, a distance of 2 mm or more is provided between the flat cable 61 and the electric cable 62.

FIG. 7(*a*) is a perspective view illustrating the lock member 56 according to the present embodiment. The lock member 56 has guide portions that hold at least two cables 61 and 62. More specifically, the lock member 56 has flat cable guides 64*a* and 64*b*, which guide the flat cable 61, and a cable guide 65, which guides the electric cable 62. In the present embodiment, the guide portions are shaped so as to correspond to two cables.

FIG. 7(*b*) is a perspective view illustrating the vicinity of the holder 37*a* before the lock member 56 is mounted. The lock member 56 is inserted in the direction of arrow D and mounted on the holder 37*a* while the flat cable 61*a* is retracted in the direction of arrow E. As illustrated in FIG. 6, the lock member 56 maintains the position of the holder 37*a* and the position of the connector 38 relative to each other. Simultaneously, the lock member 56 ensures the distance between the flat cable 61 and the electric cable 62 to be a predetermined distance or more (2 mm or more here).

With reference to FIG. 6, a configuration of the lock member 56 will be described. The flat cable 61 is held by a bundle guide (not illustrated) disposed in the holder 37*a*. A portion 61*a* of the flat cable 61 passes between the flat cable guide 64*a* and the flat cable guide 64*b* of the lock member 56. A portion 61*b* of the flat cable 61 passes over a cable guide 65 of the lock member 56. One end of the electric cable 62 is connected to the connection terminal (not illustrated) of the connector 38. A portion 62*a* of the electric cable 62 is pressed down by the cable guide 65 of the lock member 56.

Next, advantageous effects of the lock member 56 will be described. As is the case for the first embodiment, the lock member 56 fixes the position of the connector 38 relative to the holder 37*a*. The portion 61*a* of the flat cable 61 is sandwiched by the flat cable guides 64 of the lock member 56, and the position of the portion 61*a* is thereby regulated between the flat cable guide 64*a* and the flat cable guide 64*b*. The cable guide 65 of the lock member 56 is disposed between the portion 61*b* of the flat cable 61 and the electric cable 62, which prevents the portion 61*b* of the flat cable 61 and the electric cable 62 from coming closer to each other than the predetermined distance. Here, the cable guide 65 of the lock member 56 prevents the portion 61*b* of the flat cable 61 and the electric cable 62 from coming closer to each other than the thickness of the lock member 56.

In the present embodiment, in addition to the advantageous effects described in the first embodiment, the distance between the electric cable 62 and the flat cable 61 can be reliably maintained, which prevents the electric cable 62 and the flat cable 61 from coming closer to each other and thereby prevents noises from entering the electrical signals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-152379 filed Aug. 7, 2017, which is hereby incorporated by reference herein in its entirety.

What is claimed is:

1. A fixing apparatus that heats a toner image formed on a recording medium and thereby fixes the toner image onto the recording medium, the fixing apparatus comprising:

a film that is cylindrically shaped and rotates with the film in contact with the recording medium;

a heater that is in contact with an inner surface of the film;

a restricting member that restricts movement of the film in a longitudinal direction of the film;

a connector that is connected electrically to the heater for supplying electric power to the heater; and a lock member that maintains a position of the restricting member and a position of the connector relative to each other by engaging with the restricting member and the connector, the lock member being a member different from the restricting member and the connector and movable relative to the restricting member and the connector.

2. The fixing apparatus according to claim 1, wherein one of the lock member and the restricting member has one of a hole and a boss both of which engage each other, and the other one of the lock member and the restricting member has the other one of the hole and the boss both of which engage each other.

3. The fixing apparatus according to claim 1, wherein the lock member has a connector holder that holds the connector.

4. The fixing apparatus according to claim 1, wherein the restricting member has a first locking portion, the connector has a main portion, an elastic portion that is capable of elastic deformation, and a second locking portion, and the second locking portion is joined to the main portion via the elastic portion and engages the first locking portion, and the lock member has a deformation restriction portion that restricts deformation of the elastic portion and thereby prevents the second locking portion from disengaging from the first locking portion.

5. The fixing apparatus according to claim 1, wherein the lock member has a guide portion that holds a cable that is connected to the connector.

6. The fixing apparatus according to claim 1, further comprising a heater holder that holds the heater along elongated sides of the heater, wherein the connector engages an assembly of the heater and the heater holder.

7. The fixing apparatus according to claim 1, further comprising: a roller that forms a fixing nip portion for nipping and conveying the recording material in cooperation with the heater through the film.

8. A fixing apparatus that heats a toner image formed on a recording medium and thereby fixes the toner image onto the recording medium, the fixing apparatus comprising:

a film that is cylindrically shaped and rotates with the film in contact with the recording medium;

a heater that is in contact with an inner surface of the film;

a guiding member that is disposed at a position opposing an inner surface of an end of the film in a longitudinal direction of the film and that guides rotation of the film;

a connector that is connected electrically to the heater for supplying electric power to the heater; and a lock member that maintains a position of the guiding member and a position of the connector relative to each other by engaging with the guiding member and the connector, the lock member being a member different from the guiding member and the connector and movable relative to the guiding member and the connector.

9. The fixing apparatus according to claim 8, wherein one of the lock member and the guide member has one of a hole and a boss both of which engage each other, and the other one of the lock member and the guide member has the other one of the hole and the boss both of which engage each other.

10. The fixing apparatus according to claim 8, wherein the lock member has a connector holder that holds the connector.

11. The fixing apparatus according to claim 8, wherein the guide member has a first locking portion, the connector has a main portion, an elastic portion that is capable of elastic deformation, and a second locking portion, and the second locking portion is joined to the main portion via the elastic portion and engages the first locking portion, and the lock member has a deformation restriction portion that restricts deformation of the elastic portion and thereby prevents the second locking portion from disengaging from the first locking portion.

12. The fixing apparatus according to claim 8, wherein the lock member has a guide portion that holds a cable that is connected to the connector.

13. The fixing apparatus according to claim 8, wherein a heater holder that holds the heater along elongated sides of the heater, wherein the connector engages an assembly of the heater and the heater holder.

14. The fixing apparatus according to claim 8, further comprising: a roller that forms a fixing nip portion for nipping and conveying the recording material in cooperation with the heater through the film.

* * * * *